US007921016B2

(12) United States Patent
Ou

(10) Patent No.: US 7,921,016 B2
(45) Date of Patent: Apr. 5, 2011

(54) METHOD AND DEVICE FOR PROVIDING 3D AUDIO WORK

(75) Inventor: Kuen-Ying Ou, Taipei Hsien (TW)

(73) Assignee: Foxconn Technology Co., Ltd., Tucheng, Taipei County (TW)

( * ) Notice: Subject to any disclaimer, the term of this patent is extended or adjusted under 35 U.S.C. 154(b) by 807 days.

(21) Appl. No.: 11/937,386

(22) Filed: Nov. 8, 2007

(65) Prior Publication Data

US 2009/0037177 A1 Feb. 5, 2009

(30) Foreign Application Priority Data

Aug. 3, 2007 (CN) ..... 2007 1 0075612

(51) Int. Cl.
*G10L 13/06* (2006.01)

(52) U.S. Cl. ..... 704/266; 704/200; 704/220; 381/309; 381/12; 381/300

(58) Field of Classification Search ..... 704/266, 704/200, 205, 206, 220, 259; 381/309, 12, 381/303, 33
See application file for complete search history.

(56) References Cited

U.S. PATENT DOCUMENTS

| | | | | |
|---|---|---|---|---|
| 5,105,462 | A | 4/1992 | Lowe et al. | |
| 5,440,639 | A | 8/1995 | Suzuki et al. | |
| 7,085,393 | B1 | 8/2006 | Chen | |
| 7,840,019 | B2 * | 11/2010 | Slaney et al. | 381/303 |

FOREIGN PATENT DOCUMENTS

| | | |
|---|---|---|
| TW | 546982 | 8/2003 |

* cited by examiner

*Primary Examiner* — Huyen X. Vo
(74) *Attorney, Agent, or Firm* — Jeffrey T. Knapp

(57) ABSTRACT

A method for providing a 3D audio work includes providing a one-ear HRTF filter and a related function synthesizer storing a related function therein, and inputting sound signals into the one-ear HRTF filter. The sound signals are converted into one-ear output sound signals which are received by one ear and synthesized to output sound signals for the other ear. A method for providing the related function includes inputting sound signals into HRTF filters of opposite ears and obtaining output sound signals which respectively act as raw signals and target signals. The raw signals are synthesized by a synthesizer to output sound signals which compare with the target signals. A related function registered in the synthesizer is accordingly regulated so as to obtain the related function which satisfies a minimum difference between the output sound signals from the synthesizer and the target signals.

6 Claims, 3 Drawing Sheets

METHOD AND DEVICE FOR PROVIDING 3D AUDIO WORK

BACKGROUND OF THE INVENTION

1. Field of the Invention

The present invention relates generally to audio sounds and, more specifically, to a method and apparatus for customizing HRTFs (Head Related Transfer Functions) of listeners to provide more convincing and pleasurable 3D (three dimensional) audio works.

2. Description of Related Art

Some newly emerging consumer audio devices provide the option for 3D sound, allowing a more realistic experience when listening to sound. In some applications, 3D sound allows a listener to perceive motion of an object from the sound played back on a 3D audio system.

Extensive research has established that human localize sound source location by using three major acoustic cues, the interaural time difference (ITD), interaural intensity difference (IID), and head-related transfer functions (HRTFs). These cues, in turn, are used in generating 3D sound in 3D audio systems. Among these three cues, ITD and IID occur when sound, from a source in space, arrive at both ears of a listener. When the source is at an arbitrary location in space, the sound wave arrives at both ears with different time delays due the unequal path length of wave propagation. This creates the ITD. Also, due to the head shadowing effects, the intensity of the sound waves arriving at both ears can be unequal. This creates the IID.

In order to synthesize a positioned 3D audio source, a particular set of ITD, IID and a pair of HRTFs for two ears are directly measured to construct an HRTF database for listeners. In order to simulate the motion of the sound source, in addition to the varying ITD and IID, many HRTF pairs have to be used to obtain a continuous moving sound image. In the prior arts, hundreds or thousands of measured HRTFs are used to fulfill this purpose. This increases storage space of an apparatus for accommodating the HRTF database. Furthermore, when the HRTF database receives an input signal, it needs to execute complicated comparisons and calculations to make sure a listener heard a 3D audio work, which increases execution time of the apparatus. There is thus a need for a more accurate HRTF model which provides a suitable HRTF for source locations in a continuous auditory space, without annoying mass calculation and storage space.

SUMMARY OF THE INVENTION

The present invention relates, in one aspect, to a method for providing a 3D audio work. The method includes providing a one-ear HRTF filter storing a one-ear HRTF therein and a related function synthesizer storing a related function therein, and inputting sound signals into the one-ear HRTF filter. The sound signals are converted into one-ear output sound signals by the one-ear HRTF filter. The one-ear output signals are sent out and synthesized to output sound signals for the other ear by the related function synthesizer. A method for providing the related function includes inputting sound signals into HRTF filters of two opposite ears and obtaining output sound signals from the HRTF filters which are respectively acting as raw signals and target signals. The raw signals enter into and are synthesized by a synthesizer to output sound signals. The output sound signals from the synthesizer compare with the target signals in a comparator and a related function registered in the synthesizer is accordingly regulated so as to obtain the related function which satisfies a minimum difference between the output sound signals from the synthesizer and the target signals.

The present invention relates, in another aspect, to an apparatus for providing a 3D audio work. The apparatus includes a one-ear HRTF filter and a related function synthesizer. The one-ear HRTF filter stores a one-ear HRTF therein. The one-ear HRTF filter converts input sound signals into output signals for the one-ear. The related function synthesizer stores a related function reflecting signal correlation between two opposite ears. The related function synthesizer receives and synthesizes the one-ear output signals to output signals for the other ear.

Other advantages and novel features of the present invention will become more apparent from the following detailed description of preferred embodiments when taken in conjunction with the accompanying drawings, in which:

DETAILED DESCRIPTION OF THE INVENTION

Figure 1:
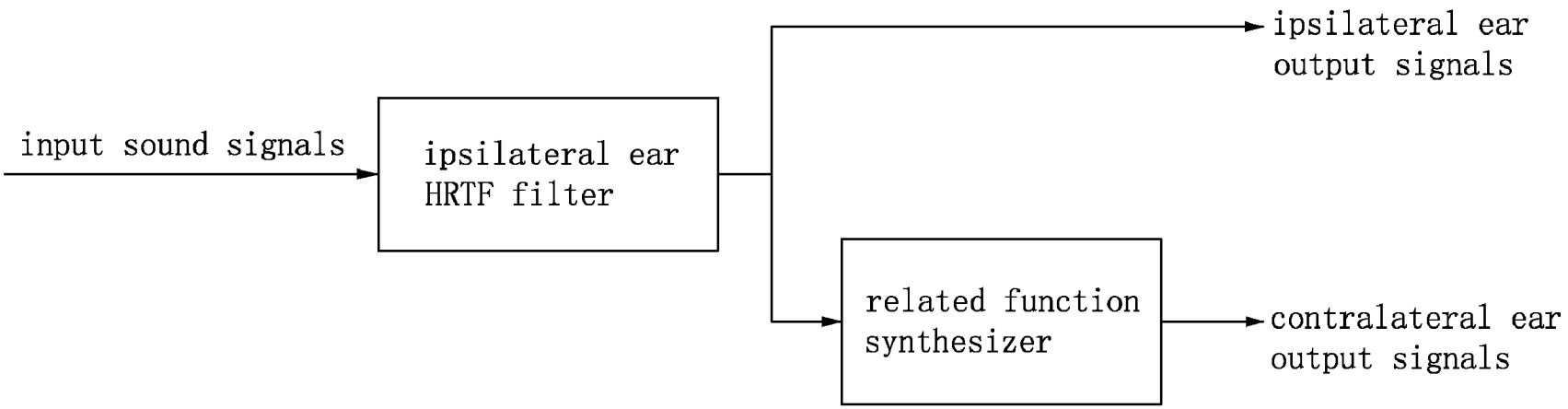
FIG. 1 is a block diagram showing an example of a method and apparatus for providing a 3D audio work.

Reference will now be made to the drawing figures to describe the preferred embodiment in detail.

The present invention provides a method and apparatus for providing a 3D (three-dimensional) audio work. The apparatus uses an HRTF filter to convert input sound signals into output sound signals which are received by one ear. The one-ear output sound signals are synthesize by a related function synthesizer to output sound signals, which are received by the other ear at the time the one-ear output signals are received by the one ear. Accordingly, the input sound signals are converted to two-ear output sound signals which are simultaneously received by the two ears and a 3D audio work for listeners is provided. During the synthesis of the one-ear output sound signals, the related function is stimulated by the one-ear output signals to obtain a related value corresponding to the one-ear output signals, and the related value adds to the one-ear output signals to obtain the output signals for the other ear.

Figure 2:
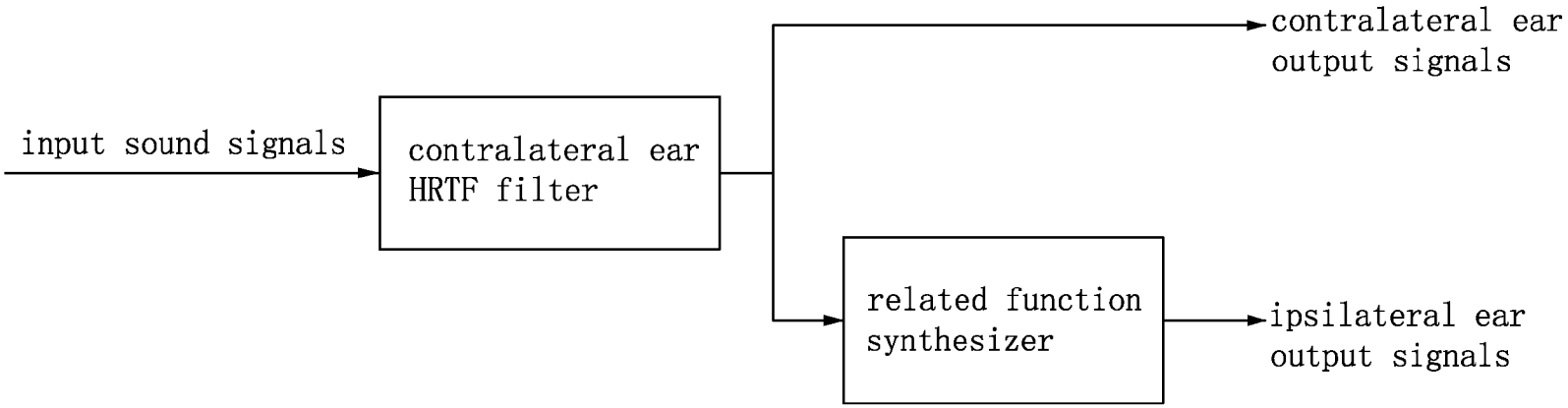
FIG. 2 is a block diagram showing another example of the method and apparatus for providing a 3D audio work.

FIGS. 1 and 2 show two preferred embodiments of the present method and apparatus. Referring to FIG. 1, the input sound signals are converted to output sound signals received by one-ear which locates adjacent to a sound source. That is, the input sound signals are converted to ipsilateral ear output sound signals via an ipsilateral ear filter. Simultaneously, the ipsilateral ear output sound signals are synthesized by the related function synthesizer to contralateral ear output sound signals. The contralateral ear output sound signals are received by the contralateral ear at the time the ipsilateral ear output signals are received by the ipsilateral ear.

Referring to FIG. 2, the input sound signals are converted to output sound signals received by one-ear which locates distant from the sound source. That is, the input sound signals are converted to contralateral ear output sound signals via a contralateral ear filter. Simultaneously, the contralateral ear output sound signals are synthesized by the related function synthesizer to ipsilateral ear output sound signals. The ipsilateral ear output sound signals are received by the ipsilateral ear at the time the contralateral ear output signals are received by the contralateral ear.

The present method and apparatus establish a one-ear HRTF database in the HRTF filter and a related function reflecting signals correlation between two ears in the related function synthesizer. Therefore, the present apparatus does not need measure too much data as the conventional apparatus which directly measures HRTFs of two ears. This reduces database storage space and amount of calculations required by the present apparatus. Details hereinafter show measurements and calculations for the HRTF database and the related function in accordance with the present invention.

The one-ear HRTF database is recorded with a set of HRTF coefficients (impulse responses) for the one-ear. The one-ear HRTF database is obtained by presenting a stimulus through a loudspeaker (the sound source) positioned at many locations in a 3D space, and at the same time collecting the impulse responses from a microphone embedded in one ear of a mannequin head or a real human subject. To simulate a moving sound, a set of continuous impulse responses that vary with respect to the sound source location are needed. The set of continuous impulse responses construct the one-ear HRTF database.

Figure 3:
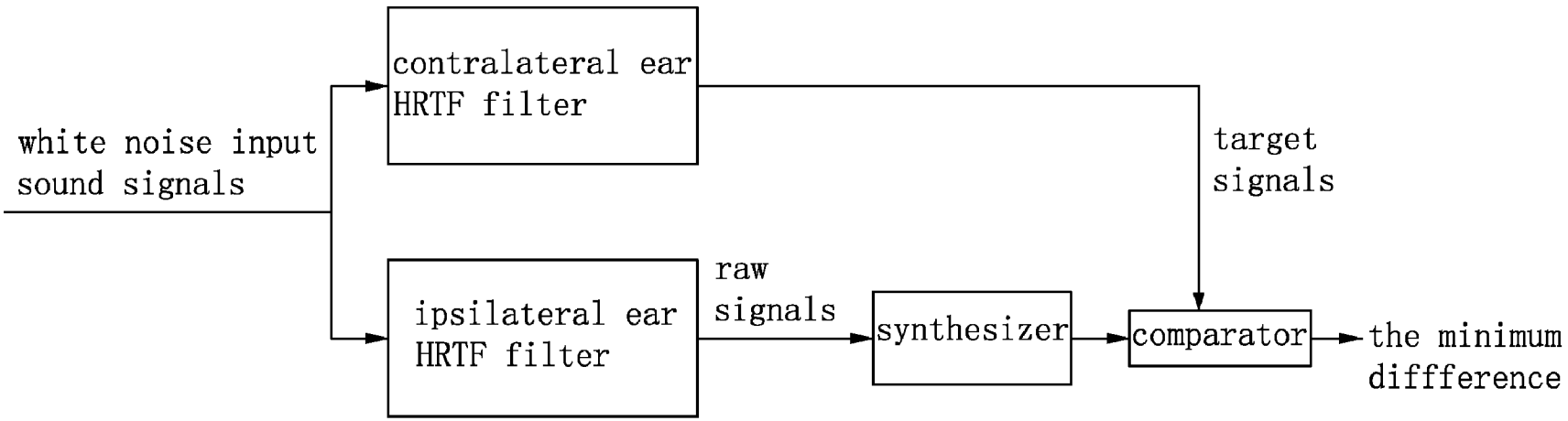
FIG. 3 is a block diagram showing a method and apparatus for providing a related function registered in a related function synthesizer of FIGS. 1 and 2.

Referring to FIG. 3, a block diagram of a method and apparatus for obtaining the related function is shown. The related function is prior calculated and registered in the related function synthesizer. The related function is obtained by inputting white noise signals respectively into an ipsilateral ear HRTF filter and a contralateral ear HRTF filter so as to obtain ipsilateral ear output signals acting as raw signals and contralateral ear output signals acting as target signals. The white noise signals have a frequency range from 20 Hz to 20 KHz, which covers a frequency range of the sound signals that can be heard by listeners, so the two-ear output sound signals can be heard by most persons. The raw signals are input into a synthesizer and are synthesized to output signals which substantially equal to the target signals. The output signals from the synthesizer compare with the target signals in a comparator and the related function registered in the synthesizer is regulated so as to keep a minimum difference between the output signals from the synthesizer and the target signals. The finally regulated related function which keeps the minimum difference is the preferred related function as needed. Alternatively, in the block diaphragm of FIG. 3, the ipsilateral ear HRTF filter and the contralateral ear HRTF filter can change positions with each other. Under this state, the white noise signals are respectively filtered by the contralateral ear HRTF filter and the ipsilateral ear HRTF filter, and contralateral ear output signals acting as the raw signals and ipsilateral ear output signals acting as the target signals are obtained. The raw signals are input into the synthesizer and are synthesized to output signals which substantially equal to the target signals. The output signals from the synthesizer compare with the target signals in the comparator so as to obtain the preferred related function which keeps the minimum difference between the output signals from the synthesizer and the target signals.

In the above-mentioned method and apparatus for obtaining the related function, the synthesizer and the comparator cooperatively construct a wiener filter. The output signals being dealt with the wiener filter are FIRs (finite impulse responses), which are steadier and have more efficiency than IIFs (infinite impulse responses) when they have the same tab. The related function obtained from this method and apparatus not only includes characteristics of ITD (interaural time difference) and IID (interaural intensity difference), but also includes parameters of head, torso and shoulder effect, external ear effect, and 3D ambience. In calculation of the related function, there is no need to divide the ipsilateral or contralateral ear HRTF by the contralateral or ipsilateral ear HRTF. Therefore, the ipsilateral and contralateral ear HRTFs are not needed to be predigested and some parameters reflecting sound characteristics can not be abnegated during the predigestion. Thus, the related function obtained from the difference between the ipsilateral and the contralateral ear HRTFs is more accurately than the related function obtained from the predigestion between the ipsilateral and contralateral ear HRTFs. Accordingly, the output sound signals of the other ear (the ipsilateral or contralateral ear), which are synthesized from the one-ear (the contralateral or ipsilateral ear) sound signals by the related function synthesizer, more realistically reflect the sound heard by the other ear of the listeners. The output sound signals of the two ears are simultaneously heard by the two ears of the listeners, which provides a 3D audio work for the listeners.

The present method and apparatus obtains a 3D audio work via inputting sound signals into the one-ear HRTF filter and the related function synthesizer. The input sound signals are filtered to the one-ear output signals by the one-ear HRTF filter, and the one-ear output signals are synthesized to the two-ear output sound signals by the related function synthesizer via simple calculation of addition between the one-ear output signals and the related function. This reduces amount and complexity of calculation of the present apparatus. In addition, the one-ear HRTF filter reduces data storage space required by the present apparatus as compared to the conventional apparatus containing two-ear HRTF filters. Thus, the present apparatus has a lower cost and a better performance than the conventional apparatus which directly measures the two-ear HRTFs. Table 1 shows the amount of calculation and the storage space for the present apparatus and the conventional apparatus which directly measures the two-ear HRTFs. MAC represents multiply-add calculation of the present and conventional apparatuses.

TABLE 1

| | Ipsilateral (taps) | Contralateral (taps) | IID | ITD | MAC |
|---|---|---|---|---|---|
| The conventional apparatus | 256 | 256 | 0 | 0 | 512 |
| the present apparatus | 256 | 40 | 1 | 1 | 296 |

Studying the data shown in table 1, the MAC of the present apparatus is lower than about 60% of that of the conventional apparatus. Thus, the present apparatus saves about 40% of the amount of calculation as compared to the conventional apparatus. This results in the data storage space of the present apparatus being saved.

It is to be understood, how ever, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for providing a 3D audio work comprising:

providing a one-ear HRTF filter which stores a one-ear HRTF therein;

providing a related function synthesizer which stores a related function reflecting signal correlation between two opposite ears therein, a method for providing the related function comprising inputting sound signals into HRTF filters of two opposite ears and obtaining output sound signals from the HRTF filters which respectively act as raw signals and target signals, the raw signals entering into and being synthesized by a synthesizer to output sound signals, the output sound signals from the synthesizer comparing with the target signals in a comparator and a related function registered in the synthesizer being accordingly regulated so as to obtain the related function which satisfies a minimum difference between the output sound signals from the synthesizer and the target signals; and inputting sound signals into the one-ear HRTF filter, the sound signals being converted into one-ear output sound signals by the one-ear HRTF filter, the one-ear output signals being received by one ear and sent out and being received and synthesized to output sound signals for another ear by the related function synthesizer.

2. The method as described in claim 1, wherein the input sound signals into the HRTF filters are white noise signals.

3. The method as described in claim 1, wherein the synthesizer and the comparator cooperatively construct a wiener filter.

4. An apparatus for providing a 3D audio work comprising:

a one-ear HRTF filter storing a one-ear HRTF therein, the one-ear HRTF filter converting input sound signals into output signals for one ear; and a related function synthesizer storing a related function reflecting signal correlation between two opposite ears, the related function synthesizer receiving and synthesizing the one-ear output signals to output signals for another ear.

5. The apparatus as described in claim 4, wherein the one-ear HRTF filter is an ipsilateral ear HRTF filter.

6. The apparatus as described in claim 4, wherein the one-ear HRTF filter a contralateral ear HRTF filter.

* * * * *